US008905410B1

(12) United States Patent
Winchester et al.

(10) Patent No.: US 8,905,410 B1
(45) Date of Patent: Dec. 9, 2014

(54) SNOWBOARD

(71) Applicants: Grant George Robert Winchester, Long Sault (CA); Robert G. Dickie, King (CA)

(72) Inventors: Grant George Robert Winchester, Long Sault (CA); Robert G. Dickie, King (CA)

(73) Assignee: Grant George Robert Winchester, Long Sault, Ontario (CA)

( * ) Notice: Subject to any disclaimer, the term of this patent is extended or adjusted under 35 U.S.C. 154(b) by 0 days.

(21) Appl. No.: 13/918,207

(22) Filed: Jun. 14, 2013

(51) Int. Cl.
*B62B 9/04* (2006.01)
*A63C 5/03* (2006.01)

(52) U.S. Cl.
CPC ..... *A63C 5/03* (2013.01)
USPC ..... 280/14.27

(58) Field of Classification Search
USPC ..... 280/87.041–87.042, 47.17, 11.19, 280/11.27, 14.27–14.28
See application file for complete search history.

(56) References Cited

U.S. PATENT DOCUMENTS 4,221,394 A 9/1980 Campbell
5,277,141 A 1/1994 Csepregi
5,411,282 A 5/1995 Shannon
6,139,031 A 10/2000 Wingard
6,345,843 B1 2/2002 Barnes
6,511,083 B1 * 1/2003 Tsai ..... 280/87.041
6,834,867 B2 12/2004 Smith
7,485,046 B2 2/2009 Dekker
2003/0214105 A1 * 11/2003 Sullivan et al. ..... 280/14.27
2005/0001393 A1 * 1/2005 McClure et al. ..... 280/14.28
2005/0110230 A1 * 5/2005 Seymour ..... 280/14.21
2010/0276912 A1 * 11/2010 Lange et al. ..... 280/727
2013/0292922 A1 11/2013 Gyr
2014/0070503 A1 3/2014 Elkinton

* cited by examiner

*Primary Examiner* — John Walters
*Assistant Examiner* — James Triggs
(74) *Attorney, Agent, or Firm* — Sand & Sebolt

(57) ABSTRACT

A snowboard without foot bindings enables a rider to perform skateboard tricks while sliding on snow. A pair of runner boards is connected in a spaced longitudinal relationship by a strut. A pole is attached to the strut by a universal joint enabling a rider to perform maneuvers while holding onto a handle at the end of the pole. The universal joint enables the runner boards to rotate 360° about a longitudinal axis extending along the board and rotate 360° about a vertical axis and other angles therebetween providing the same freedom of movement to the runner boards that a skateboard provides for its rider. The pole is pivotally mounted to the connector enabling the pole to pivot through an arc of at least 180°.

20 Claims, 20 Drawing Sheets

SNOWBOARD

BACKGROUND OF THE INVENTION

1. Technical Field

The invention relates to snowboards and in particular to a snowboard without bindings allowing the user to perform many of the classic skateboard tricks on snow. More particularly, the invention relates to a snowboard having a pair of runner boards and a vertically extending pole connected to the runner boards by a universal joint enabling the runner boards to rotate 360° about a longitudinal axis, as well as 360° about a vertical axis giving a snowboarder the opportunity to perform tricks similar to those performed by a skateboarder.

2. Background Information

Skateboarding is a popular past time for children and young adults on the neighborhood streets and in skate parks, as well as professional skateboarders. Skateboards are intended to be used on pavement with two-wheel truck assemblies moveably supporting the board. Because the skateboard is not attached to the user's feet, it allows many tricks to be performed like flipping the board over and in a circular manner not possible with a snowboard due to the attachment of the snowboarder's feet to the board.

Some of the basic tricks and maneuvers performed by a skateboard which would be desired to be duplicated by a snowboarder are listed below.

The Kickflip is a trick in which the rider kicks their front foot off of the board to the heel side to create enough force to spin the board one full 360° rotation. If flicked harder, two or three full flips can be imparted on the axis. These are called Double or Triple Kickflips.

An Ollie Heelflip is the same as a Kickflip, only the board spins outwardly away from the rider's body and under their feet before they land.

A Pop Shove-it is a combination of the Ollie and the Shove-it. During a Pop Shove-it, the rider initiates an Ollie, but shifts the weight of their back foot so that the board spins 180° vertically. Pop Shove-its were also known as Ollie Varials.

Also known as an Ollie 360 Varial, the 360 Pop Shove-it trick is simply a Pop Shove-it except that the board is rotated 360° instead of 180°.

The 360 flip is a classic trick combination of a 360 Pop Shove-it with an Ollie Kickflip. The 360 Heelflip is simply a Heelflip merged with a frontside 360 Shove-it.

A Varial Kickflip is a trick which is a combination of a Backside Pop Shove-it and a Kickflip. The board spins 180° while flipping. A Varial Heelflip combines a Frontside Pop Shove-it with a Heelflip.

A Hardflip combines a Frontside Pop Shove-it with an Ollie Kickflip. It can go vertically or horizontally, but both complete a 180° rotation and a Kickflip.

These tricks or maneuvers cannot be performed by a snowboarder because the user is attached to the snowboard by bindings, although many snowboarders are also skateboarders and would like to duplicate the skateboard maneuvers with a snowboard.

Therefore, it is desirous that a snowboarder be able to perform many of the skateboard maneuvers and tricks not heretofore possible with known snowboard constructions.

SUMMARY

In one aspect, the invention may provide a runner board having upper and bottom surfaces extending along a longitudinal axis and terminating in front and back ends; a pole extending upwardly from the upper surface of the runner board generally along a vertical axis; and a universal joint connecting the pole to the runner board enabling the runner board to rotate substantially 360° about the vertical axis and substantially 360° about the longitudinal axis.

In another aspect, the invention may provide a pair of runner boards adapted to support the feet of a rider, said boards being free of any foot bindings; a strut rigidly connecting the pair of runner boards in a spaced longitudinal orientation; a connector rotatably connected to the strut enabling the runner boards to rotate with respect to the connector about a longitudinal axis extending through the strut and runner boards; a pole having an upper handle extending from the connector; and a universal joint connecting the pole to the connector enabling the runner boards to rotate and pivot about the pole.

BRIEF DESCRIPTION OF THE SEVERAL VIEWS OF THE DRAWINGS

A sample embodiment of the invention, illustrative of the best mode in which Applicant contemplates applying the principles, is set forth in the following description, is shown in the drawings and is particularly and distinctly pointed out and set forth in the appended claims.

Similar numbers refer to similar parts throughout the drawings.

DETAILED DESCRIPTION

Figure 1:
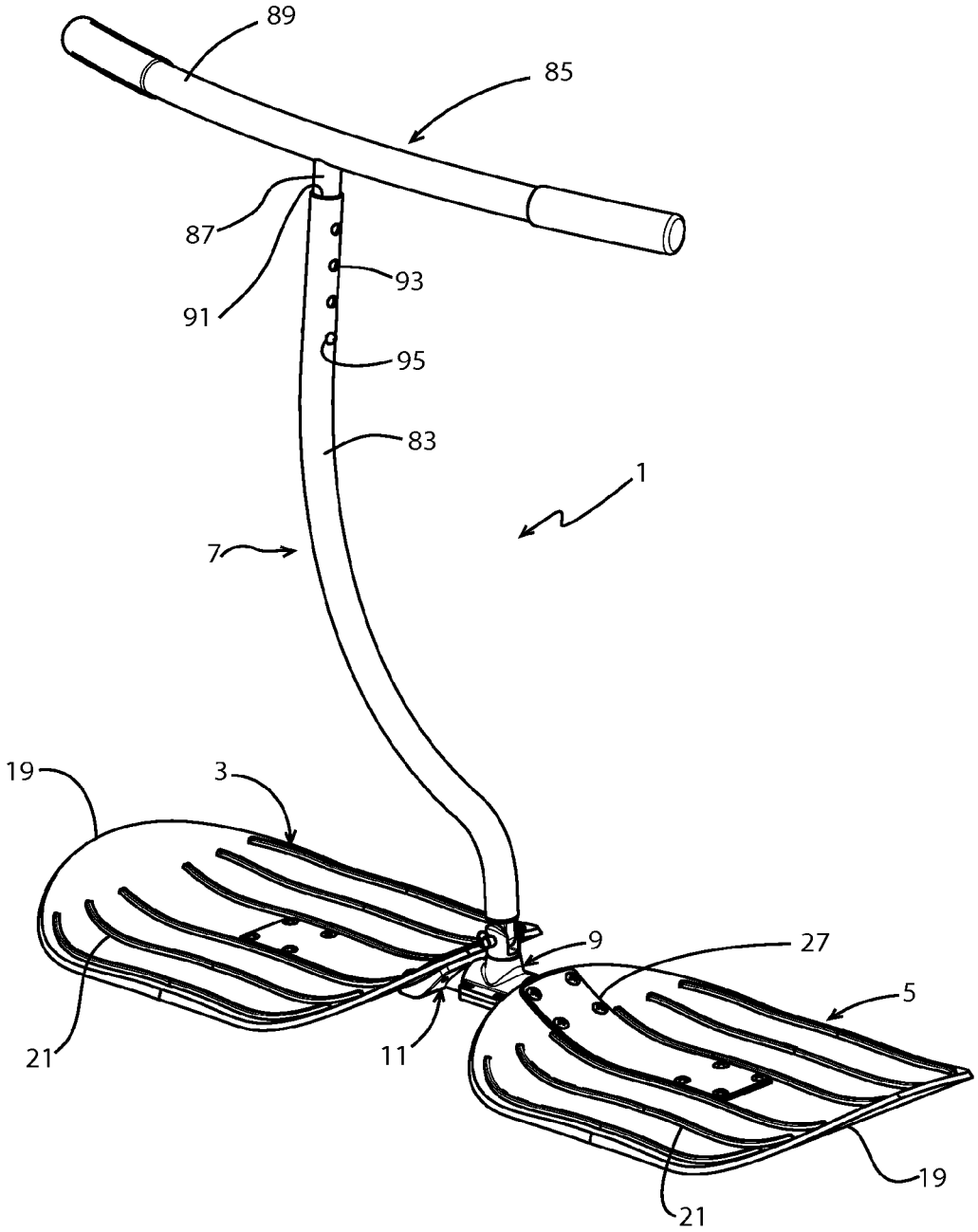
FIG. 1 is a perspective view of the snowboard of the present invention.
Figure 2:
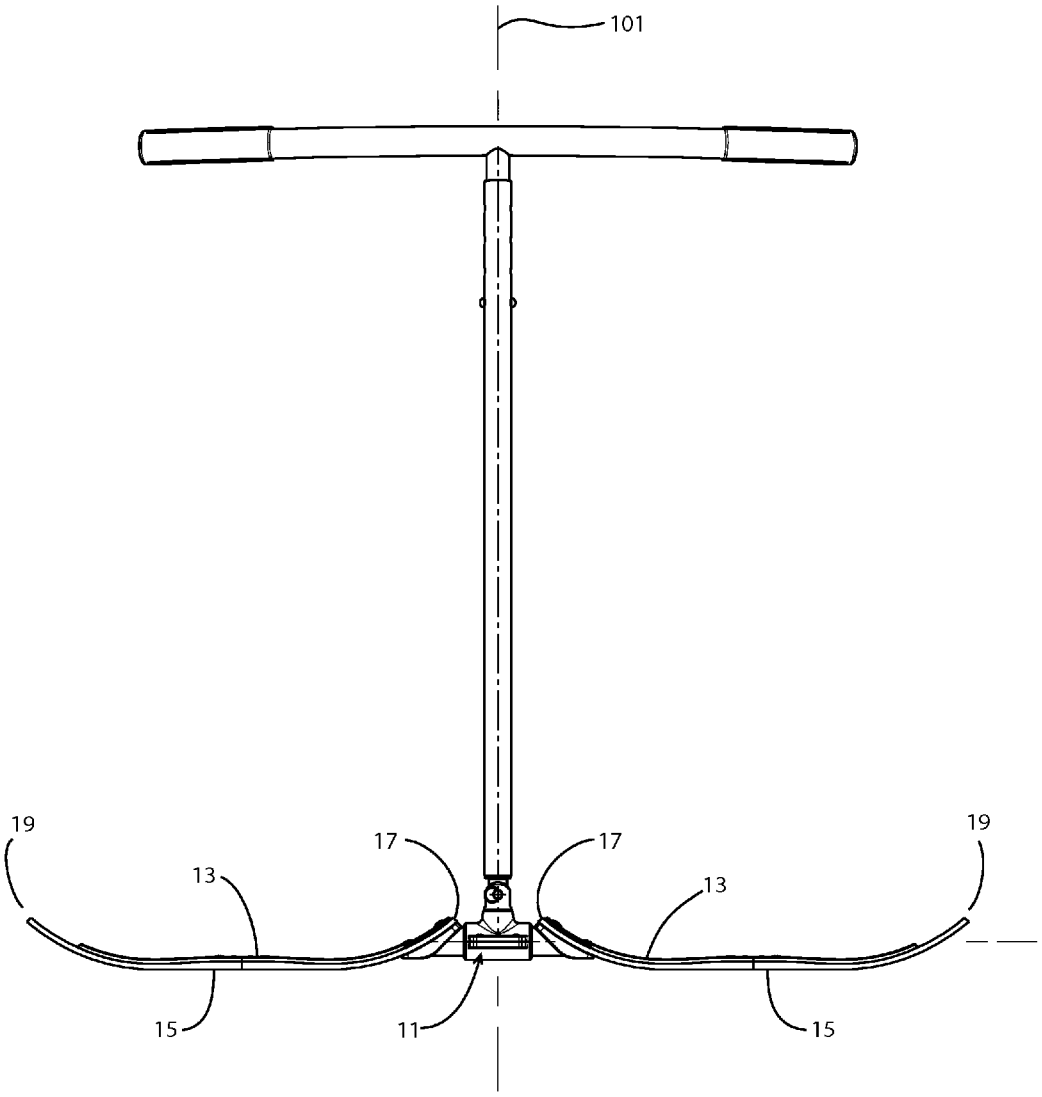
FIG. 2 is a side elevational view of the snowboard of FIG. 1.

The unique snowboard of the present invention is indicated generally at 1, and is shown particularly in FIGS. 1-8. Snowboard 1 includes as its main components a pair of foot runner boards indicated generally at 3 and 5, a pole 7 extended vertically upwardly from a connector 9 which is mounted on a strut 11 rigidly connected to and extending between runner boards 3 and 5. In accordance with one of the main features of the invention, pole 7 and runner boards 3 and 5 are connected to strut 11 by a universal joint 8.

Runner board 3 and 5 preferably are similar to each other thereby economizing production costs. Each of the runner boards includes a top surface 13 and a bottom surface 15 and terminate in rounded upwardly sloped ends 17 and 19, respectively. Each of the top surfaces 13 have a generally flat planar configuration extending between turned up ends 17 and 19 which provide areas on which a user will stand when riding the snowboard. The bottom surfaces 15 also have generally planar configurations extending between the turned up ends in order to provide a large smooth sliding surface for gliding the snowboard over the snow. The bottom surfaces of runner boards 3 and 5 lie in a common plane as shown by dot-dash line 20 in FIG. 5. Runner boards 3 and 5 preferably are formed of aluminum, metal, or composite materials and preferably have a plurality of non-slip friction material 21, which can be in the form of strips, mounted on top surfaces 13 and extending longitudinally therealong to provide a non-slip surface for the user's feet. Other types of non-slip surfaces can be utilized within the concept of the invention.

A reinforcing stiffener strip 23 is secured to each of the runner boards and extends longitudinally along at least a portion of the top surfaces thereof and are secured to the runner boards by a plurality of screws 25. The inner ends of each stiffening strip 23 is also connected to connector 9 (FIG. 6) by four screws 27 which also assist in securing stiffening strips 23 to the top surfaces of the runner boards. The outer ends of strut 11 terminate in slightly curved sloped surface 11A and 11B (FIGS. 6 and 8) formed with threaded holes 26 for receiving fasteners 27 therein. Strut 11 preferably is formed of die cast aluminum and has a central cylindrical area 29 which terminates in the spaced curved surfaces 11A and 11B to which the ends of stiffening strips 23 are secured by screws 27. A through bore 33 is formed in strut 11 to reduce the weight thereof without sacrificing strength.

Figure 6:
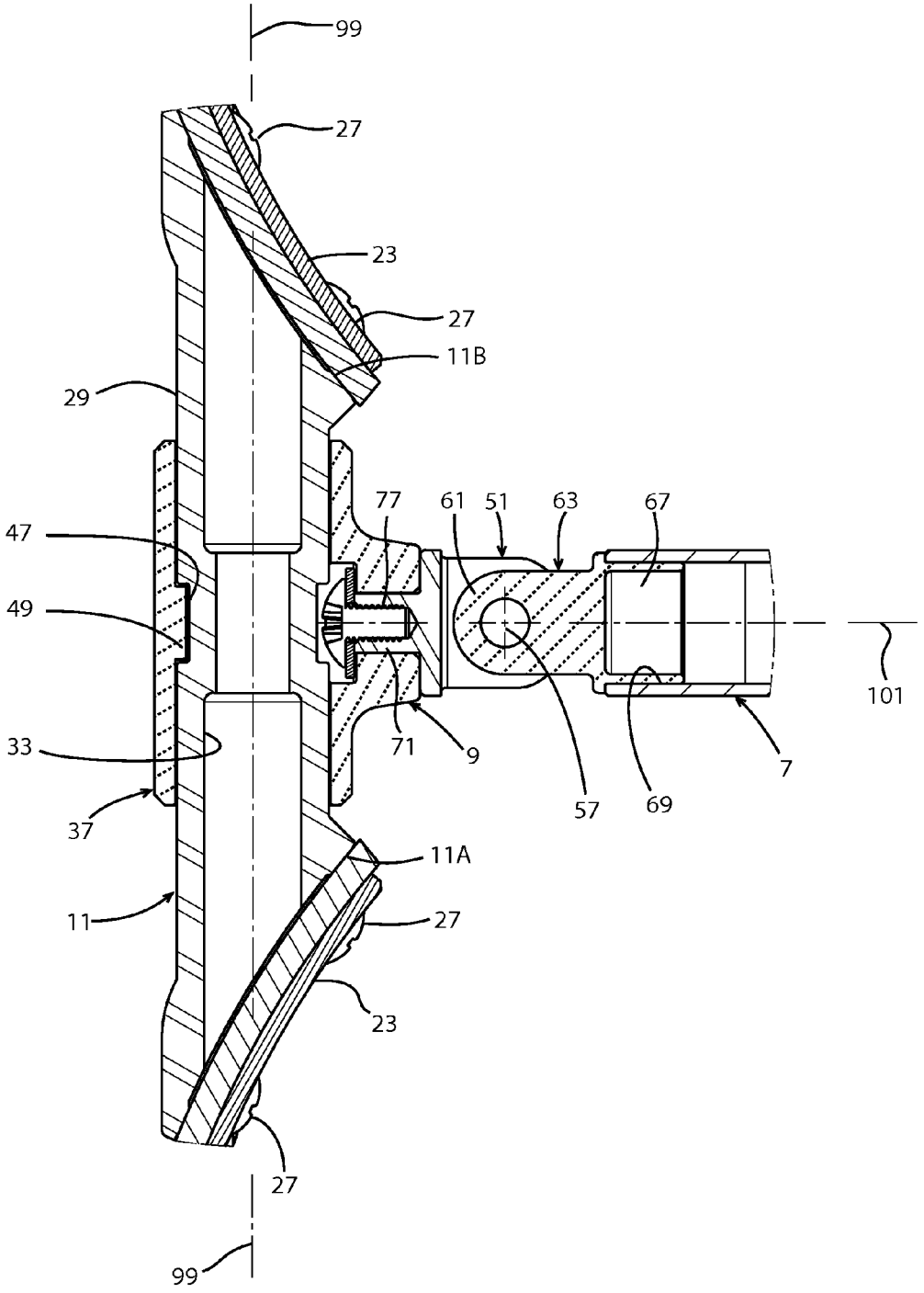
FIG. 6 is an enlarged sectional view of the encircled portion of FIG. 5 showing the construction of the universal joint.
Figure 7:
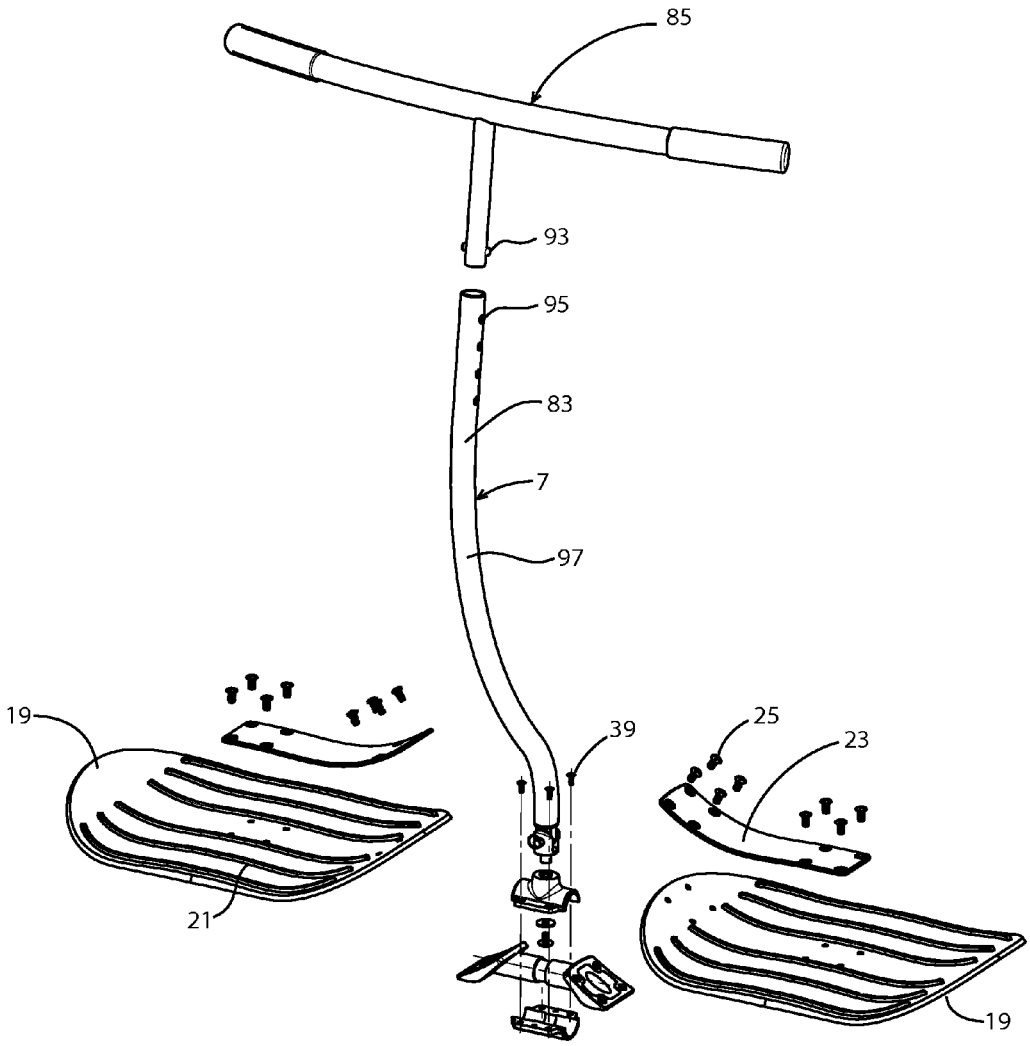
FIG. 7 is an exploded perspective view of the snowboard of FIG. 1.
Figure 8:
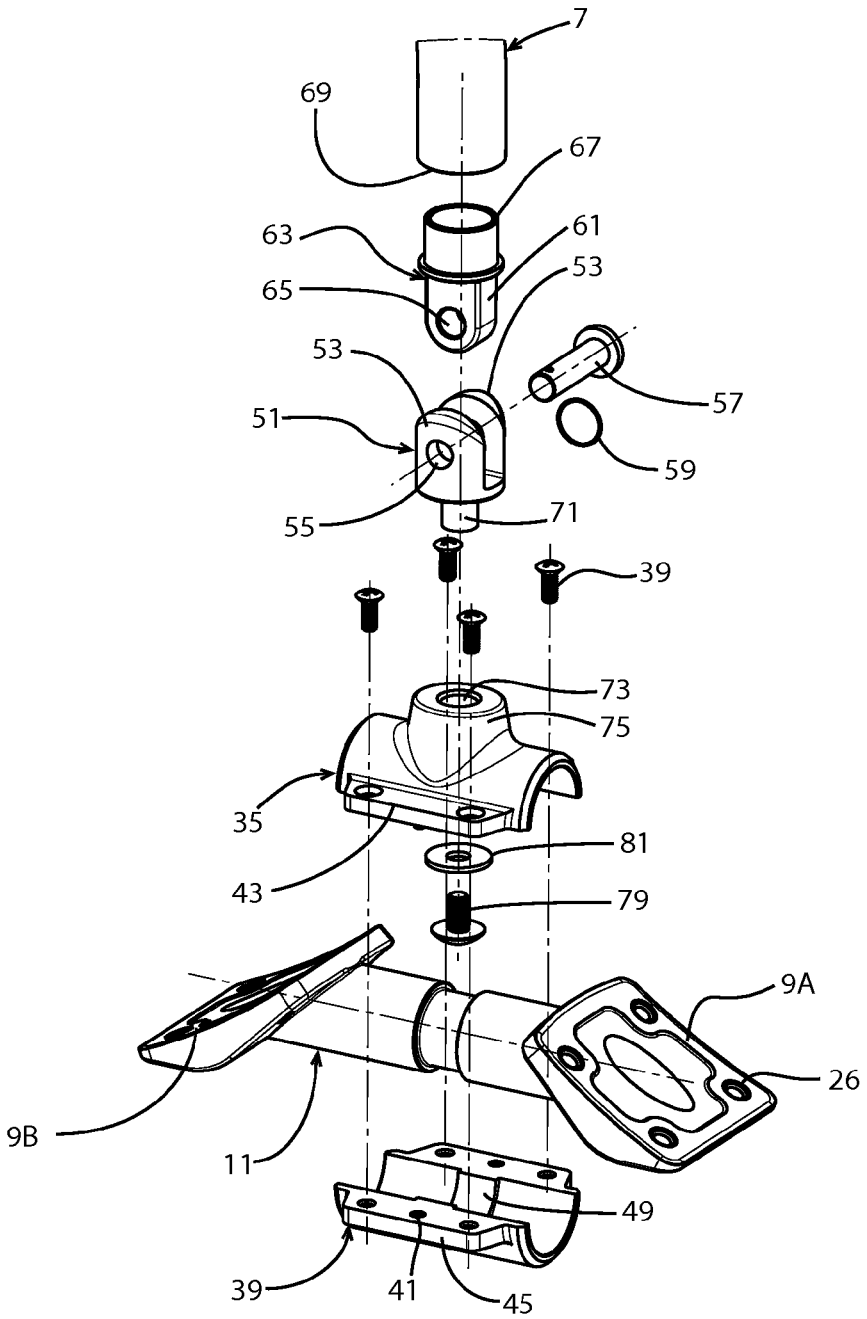
FIG. 8 is an enlarged exploded view of the universal joint and strut of the snowboard as shown in FIG. 7.

Connector 9 is best shown in FIGS. 6-8 and includes top and bottom U-shaped clamp members 35 and 37, respectively, which are rotatably mounted on and secured about the central cylindrical area 29 of strut 11 by a plurality of fasteners 39 which extend through aligned holes 41 formed in outwardly projecting flanges 43 extending along the sides of the U-shaped clamps. As best shown in FIG. 6, a circular groove 47 is formed in the center of cylindrical area 29 in which is seated an outwardly extending arcuate rib 49 formed in lower clamp 37. These components accurately position connector 9 on strut 11 and prevent axial movement of the connector 9 along strut 11 (FIG. 6) while permitting 360° rotation of connector 9 on strut 11.

Universal joint 8 (FIGS. 6-8) includes a clevis indicated generally at 51, having a pair of spaced flanges 53, each of which is formed with a hole 55 for receiving a pivot pin 57 therein and a bushing washer 59 for pivotally receiving a lug 61 therein. Lug 61 is part of a plug indicated generally at 63, and is formed with a hole 65 which aligns with clevis holes 55 for receiving pivot pin 57 therein. Plug 63 terminates in a cylindrical end 67 which is received within an open end 69 of pole 7. Clevis 51 further includes a downwardly extending cylindrical post 71 which extends through a hole 73 formed through a circular boss 75 extending upwardly from U-shaped clamp 35. Post 71 is formed with an internally threaded opening 77 (FIG. 6) in which is secured a bolt 79. Bolt 76 together with a washer 81 rotatably mounts clevis 51 and correspondingly connected pole 7 on connector 9 and consequently with respect to runner boards 3 and 5.

In accordance with another feature of the invention, pole 7 includes a mast 83 which preferably is a hollow tubular member, which terminates in an open bottom end 69 for receiving cylindrical end 67 of plug 63. A T-shaped handle 85, which includes a post 87 and a cross member 89 extending at generally right angles thereto, is adjustably mounted within a top open end 91 of mast 83. Handle 85 is retained in a vertically adjusted position within open end 91 of mast 83 by spring biased ball detents 93 or other type fasteners, which can be selectively received within one of a plurality of holes 95 formed in the upper end of mast 83.

Figure 3:
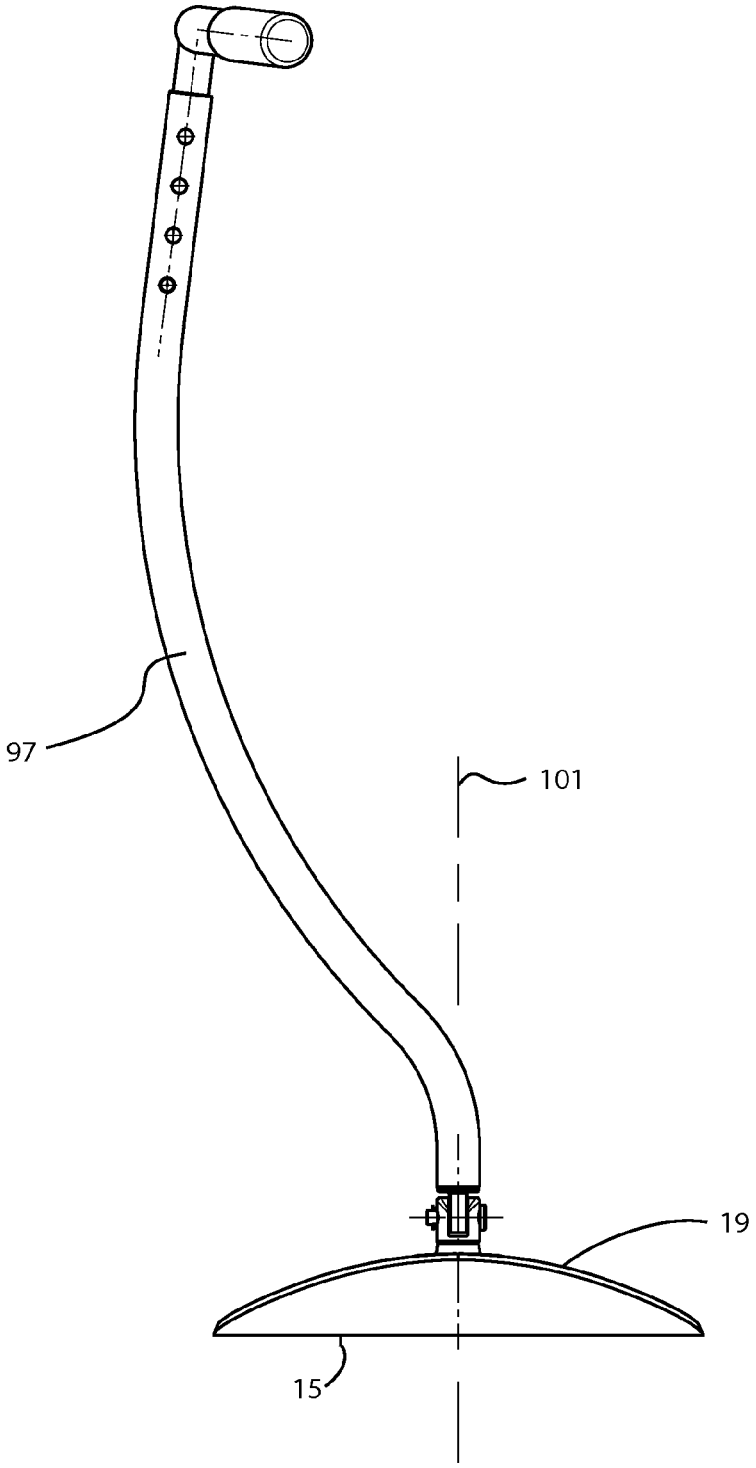
FIG. 3 is a right hand elevational view of the snowboard of FIG. 1.

Another feature of pole 83 is that it is formed with a curved central area 97 as shown in FIG. 3, in order to provide clearance for the torso of a user when standing upon runner boards 3 and 5.

Figure 4:
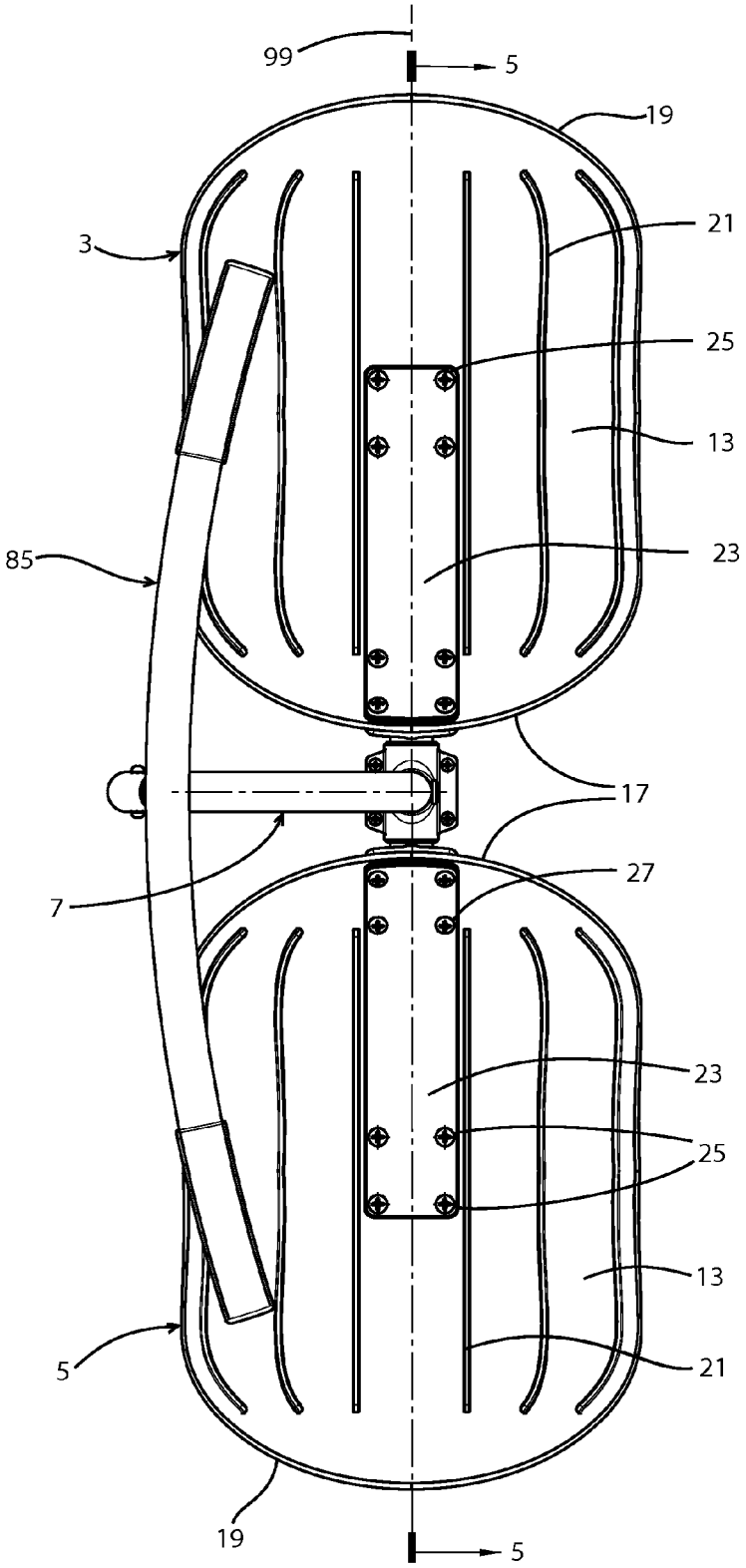
FIG. 4 is a top plan view of the snowboard of FIG. 1.

As best shown in FIG. 4, runner boards 3 and 5 are arranged in a spaced longitudinal relationship and extend along a longitudinal axis 99, which also corresponds with bore 33 of strut 11, and which is perpendicular to a vertical axis 101 which extends vertically upwardly from the center of connector 9 and strut 11, and which is generally parallel with pole 7.

Figure 5:
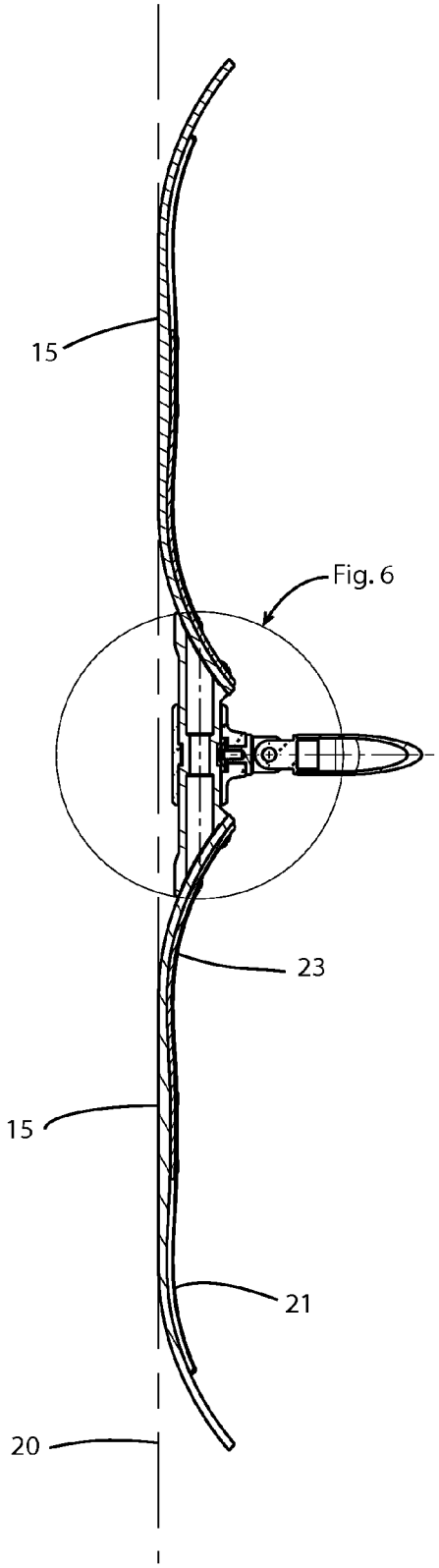
FIG. 5 is a sectional view taken on line 5-5, FIG. 4.

Furthermore, as shown in FIG. 5, the bottom surfaces 15 of runner boards 3 and 5 will be slightly lower than bottom U-shaped clamp 37 and provides a large surface area for sliding smoothly along the snow, without connector 9 causing any ground interference.

In a preferred embodiment, each runner board has a longitudinal length of 11 inches and a width of 9 inches, with pole 7 having an adjustable height of between 28 inches and 32 inches.

Figure 20:
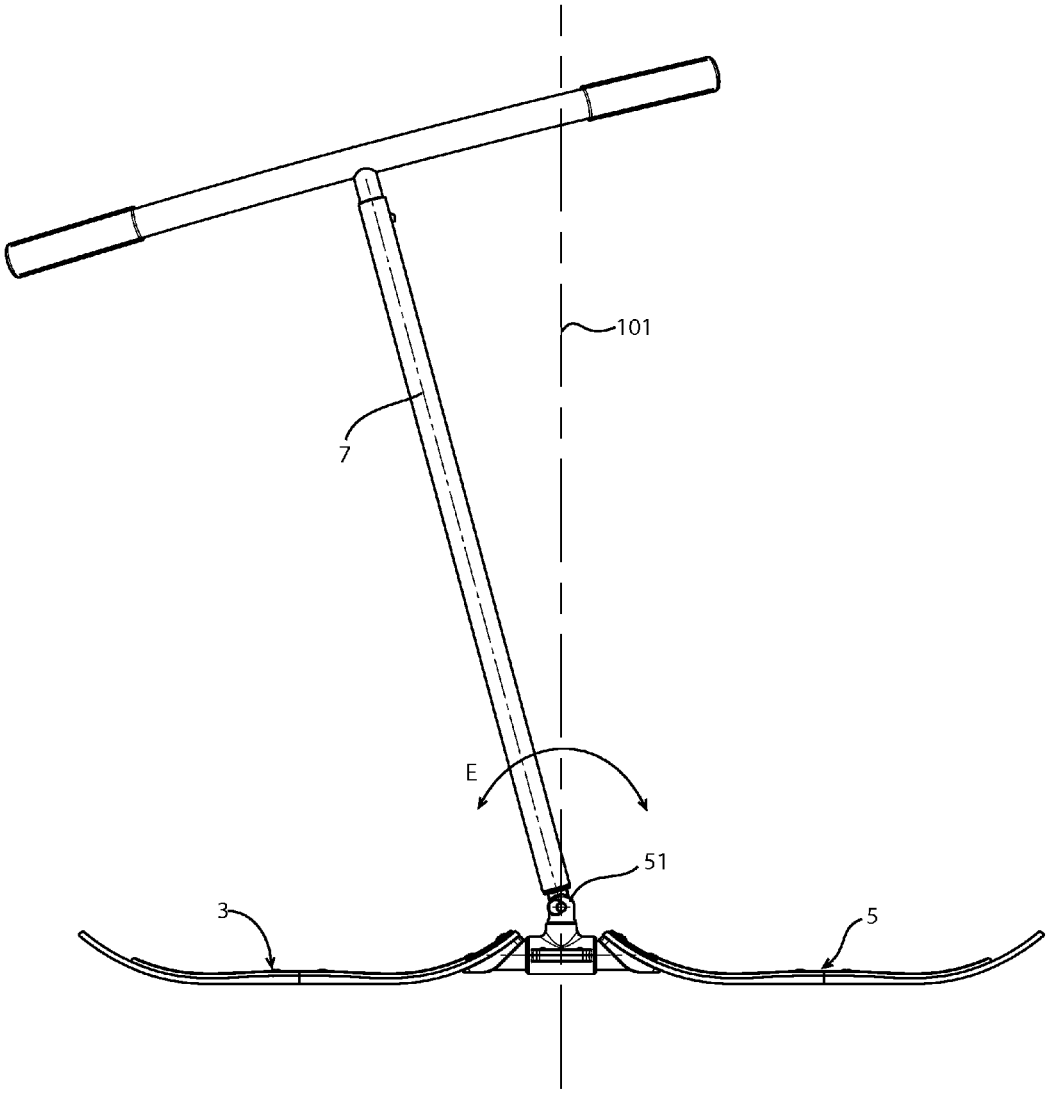
FIG. 20 is a side elevational view of the snowboard showing the pivotal movement of the handle with respect to the vertical axis.

In accordance with one of the features of the invention easily visualized in FIGS. 2-8 and described more fully below, runner boards 3 and 5 can rotate 360° around longitudinal axis 99 by the rotational connection between connector 9 and strut 11. Furthermore, the rotational movement of the lower end of clevis 51, and in particular post 71 within hole 73 of circular boss 75 of connector 9, enables the runner boards to rotate 360° about pole 7 and vertical axis 101. These movements provided by the universal joint 8, and in particular the rotational mounting of strut 11 with respect to connector 9, and the pivotal rotational mounting of pole 7 with respect to connector 9, provides for 360° rotational motion of runner boards 3 and 5 about the longitudinal or horizontal axis 99, as well as a 360° rotational motion of the runner boards about pole 7 and vertically extending axis 101. Furthermore, pivotal movement of at least 180° is provided by pole 7 with respect to the runner boards by the pivotal connection of pivot pin 57 with clevis 51 as shown in FIG. 20.

This freedom of movement provided by universal joint 8 enables nearly all of the maneuvers and tricks possible with a skateboard to be accomplished by a snowboarder since he or she is free of any foot bindings with the contact between the user and runner boards being accomplished through the grasping of handle 85 of pole 7 and manipulation of the runner boards by the user's feet as done with a skateboard.

Figure 9:
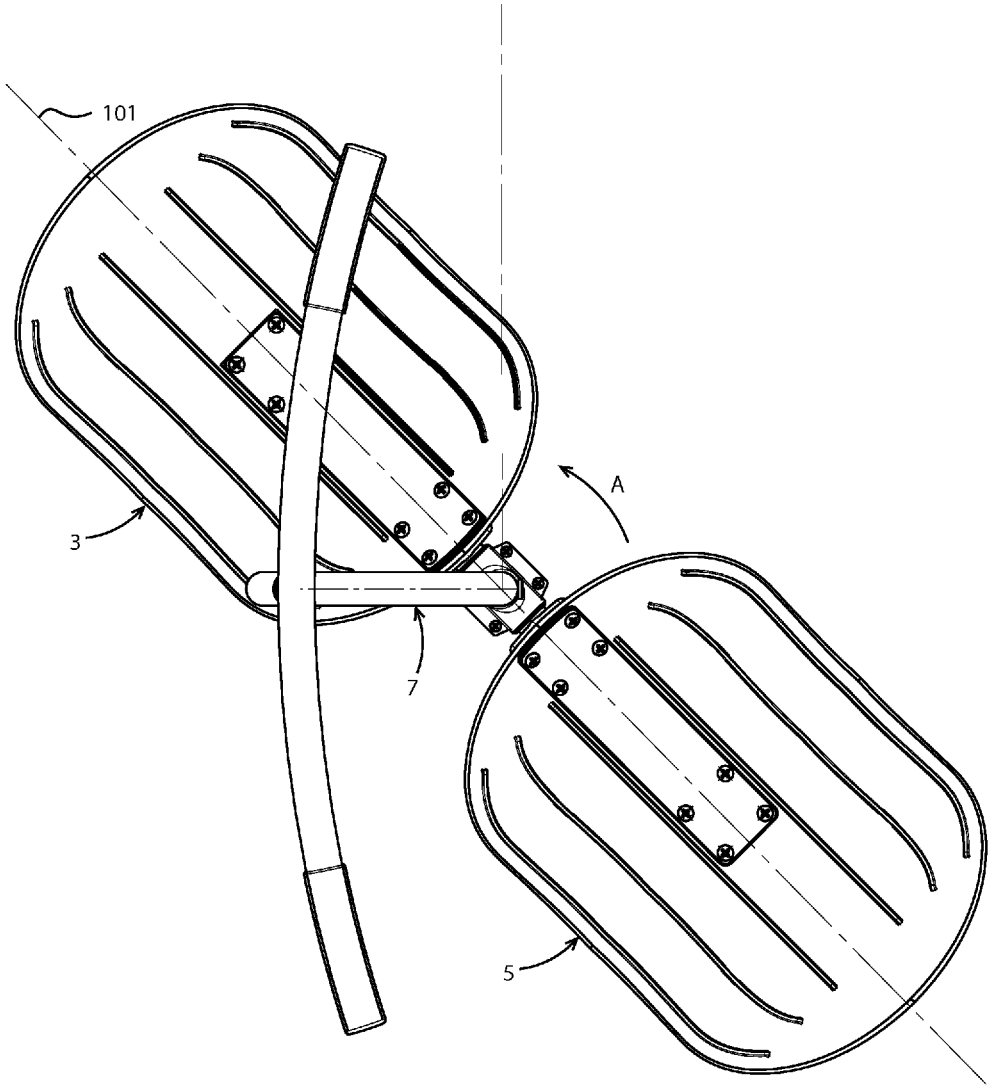
FIG. 9 is a top plan view of the snowboard as it starts to rotate about the pole from a start position as shown in FIG. 1.
Figure 10:
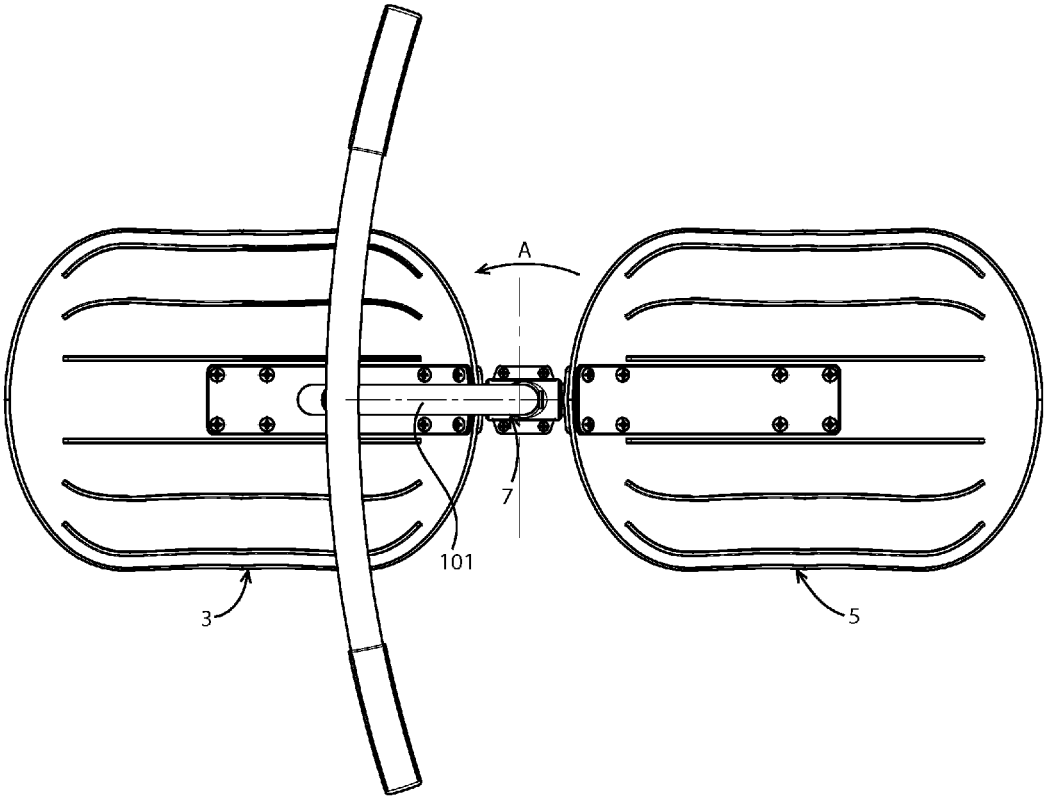
FIG. 10 is a view similar to FIG. 9 showing a 90° rotation of the snowboard about the pole from the position of FIG. 4.
Figure 11:
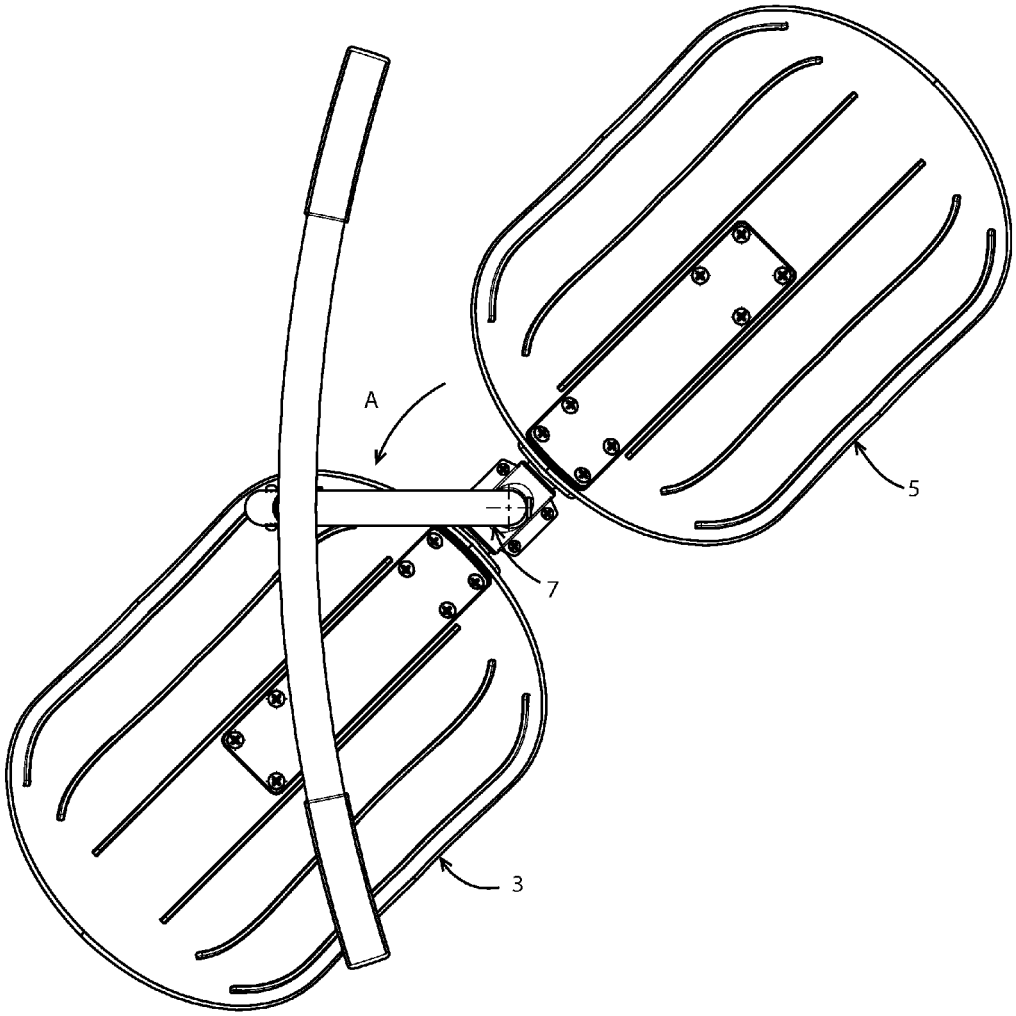
FIG. 11 is another view similar to FIGS. 9 and 10 showing a further rotation of the snowboard about the pole.

FIGS. 9-20 show some of the movement that can be accomplished by a snowboarder similar to that achieved by a skateboarder on snowboard 1 due to the unique connection of the snowboard runner boards to the pole through the universal joint. One manner of using the snowboard of the present invention is illustrated in FIGS. 9-20. FIGS. 1-4 show the usual starting position taken by a snowboarder with respect to pole 7, which as shown in FIG. 4, will provide clearance from the torso of the user due to curved area 97, when the snowboarder has a foot on each of the respective runner boards 3 and 5, in which position, pole 7 preferably will be in a vertical upright position. FIGS. 9-11 show the ability of runner boards 3 and 5 to rotate horizontally 360° around pole 7, and in particular, around vertical axis 101. As shown in FIG. 9, the runner boards have rotated in the direction of Arrow A through an angle of approximately 45° with respect to the vertical axis from the starting position of FIG. 5. Continued movement of the user's body as shown in FIG. 10 will rotate the runner boards through 90°. Continued counterclockwise rotation along Arrow A as shown in FIG. 11, the runner boards have rotated approximately 135° about the vertical axis. It is easily seen that continued rotation of the runner boards by the body movement of the user as he or she grips handle 85 can complete a 360° rotation due to the sliding rotational movement of the lower portion of clevis post 71 within hole 73 of circular boss 75 on connector 9.

Figure 12:
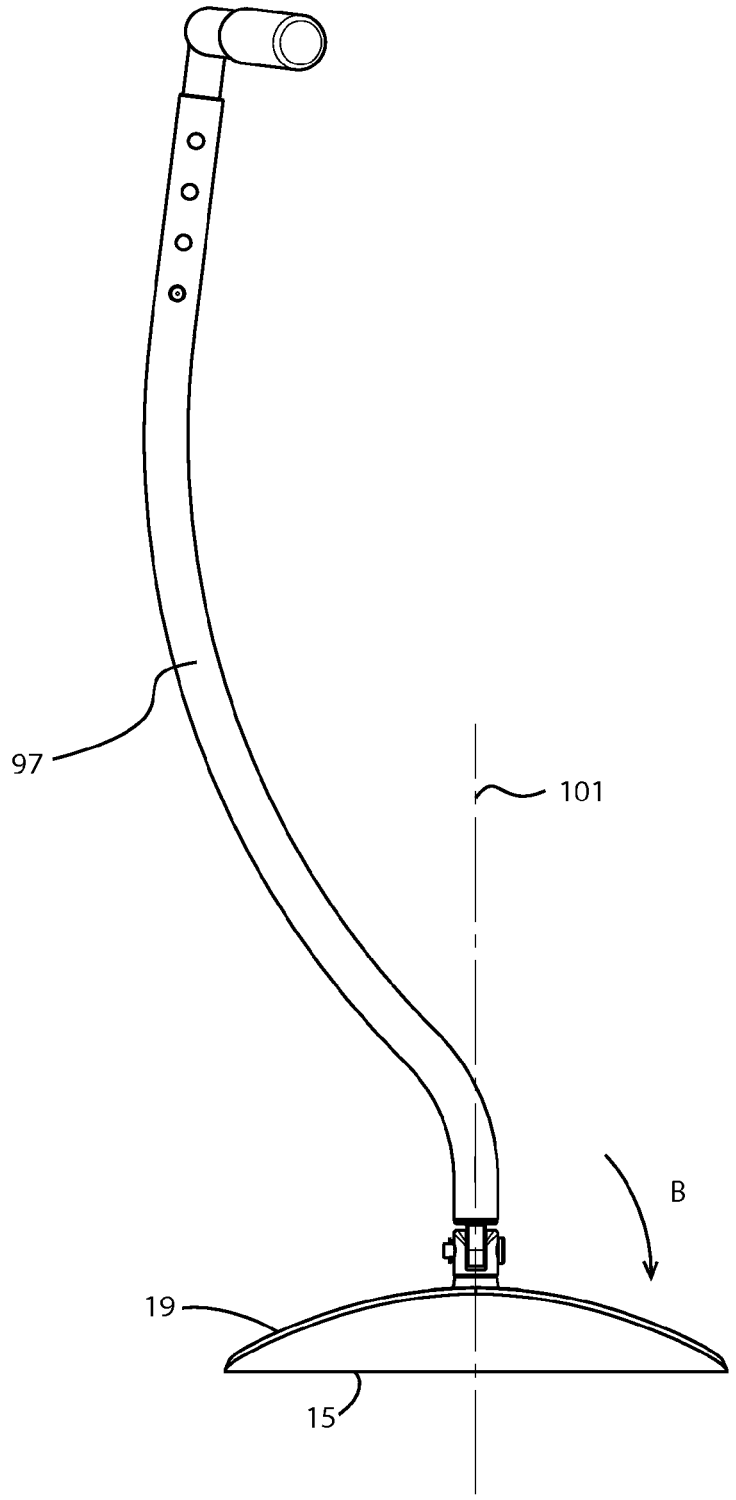
FIG. 12 is an end elevation of the snowboard showing the position of the handle and snowboard after the snowboard has rotated 360°.
Figure 13:
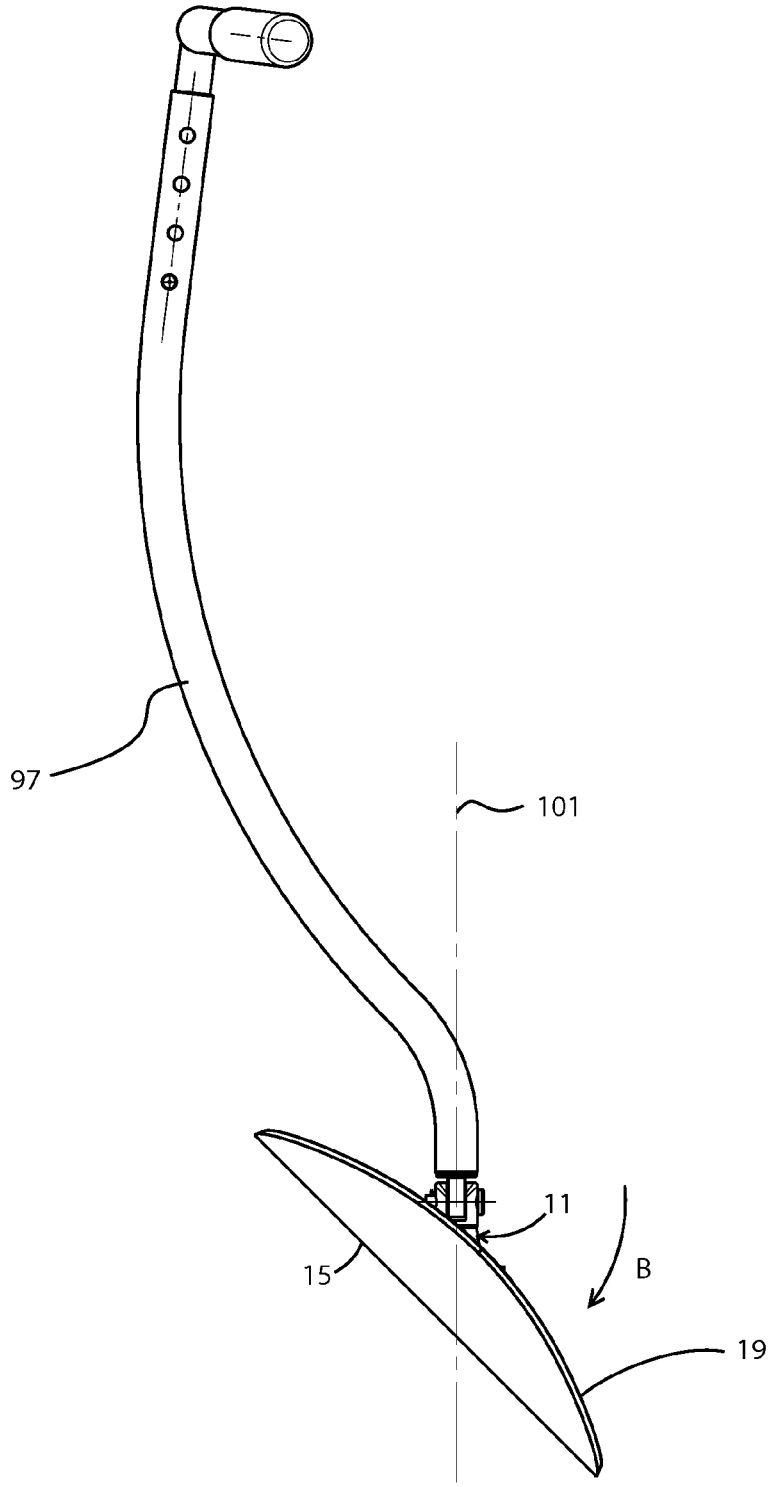
FIG. 13 is a view similar to FIGS. 3 and 12 showing the start of rotation of the snowboard about the connecting strut and a longitudinal axis extending through the snowboard.
Figure 14:
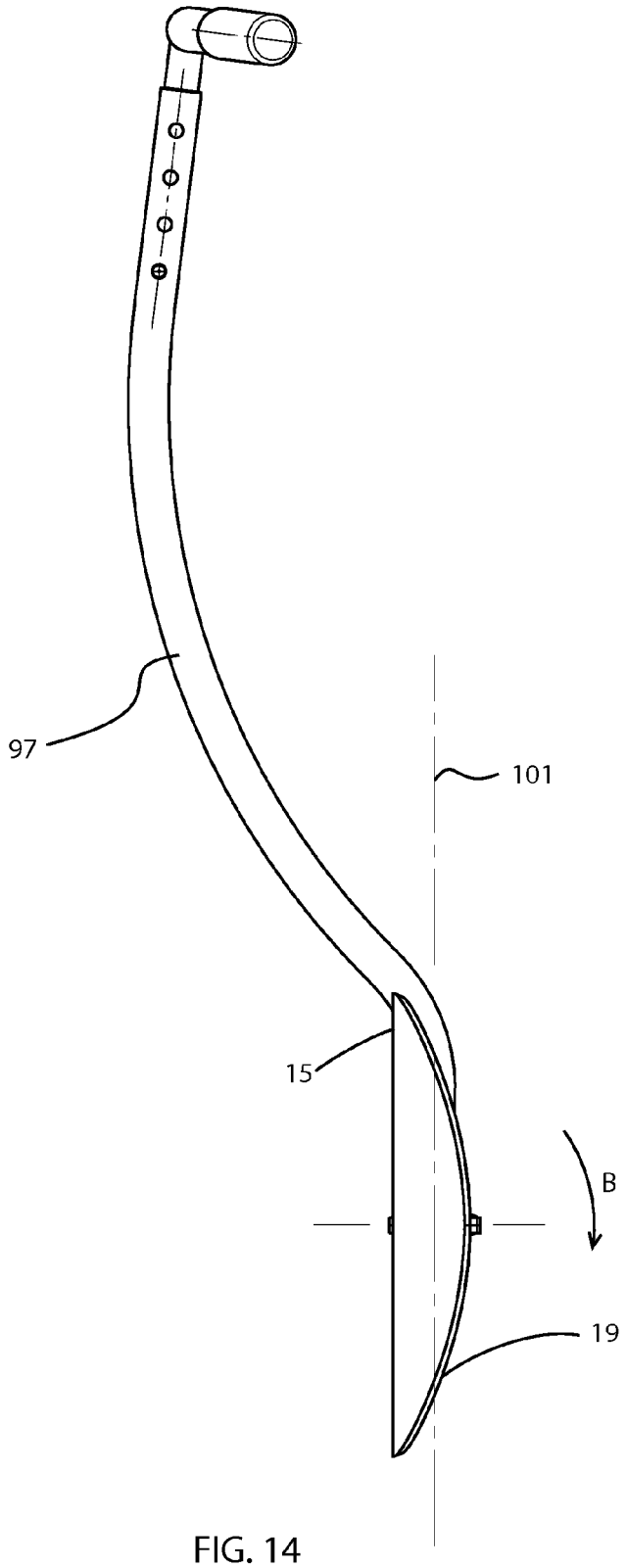
FIG. 14 is a view similar to FIGS. 12 and 13 showing rotation of the snowboard through 90° about the longitudinal axis.
Figure 15:
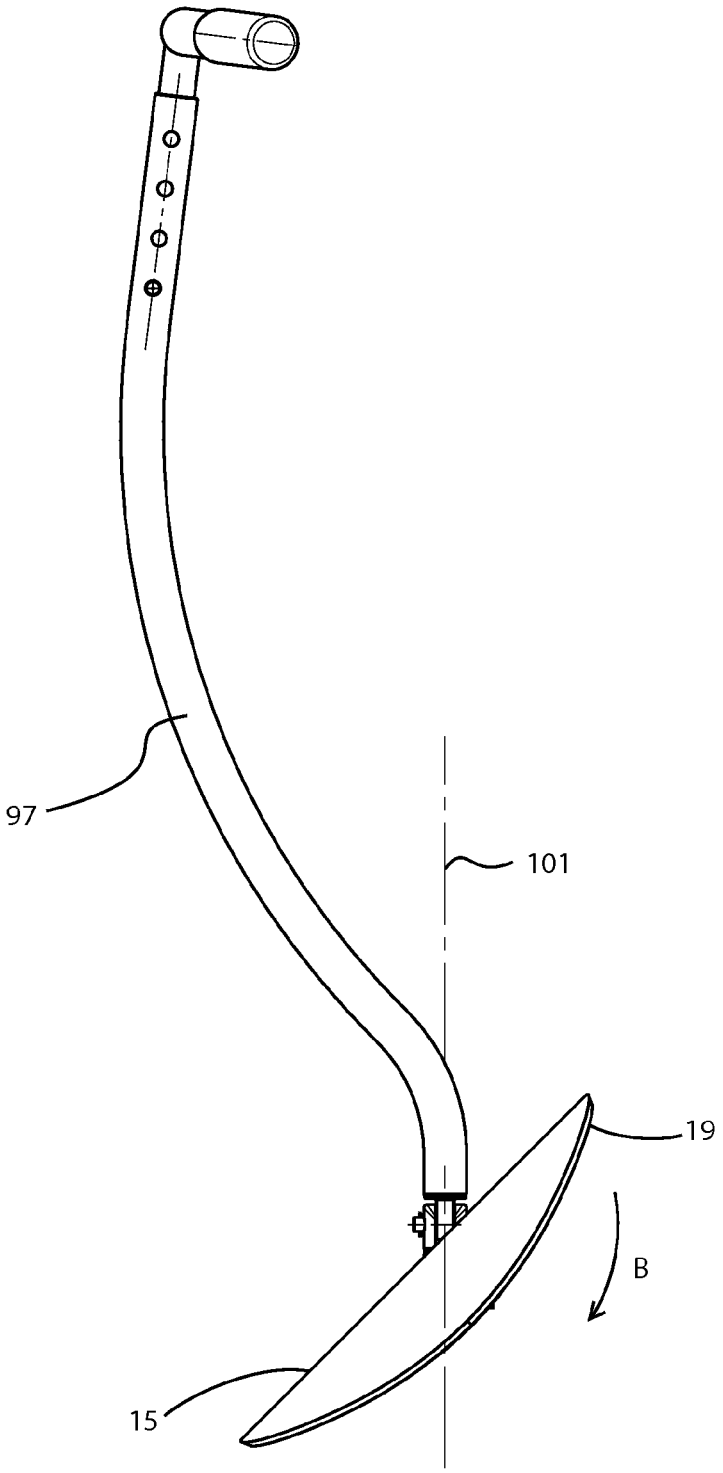
FIG. 15 is a view similar to FIGS. 12-14 showing further rotation of the snowboard past the 90° rotation as show in FIG. 14.
Figure 16:
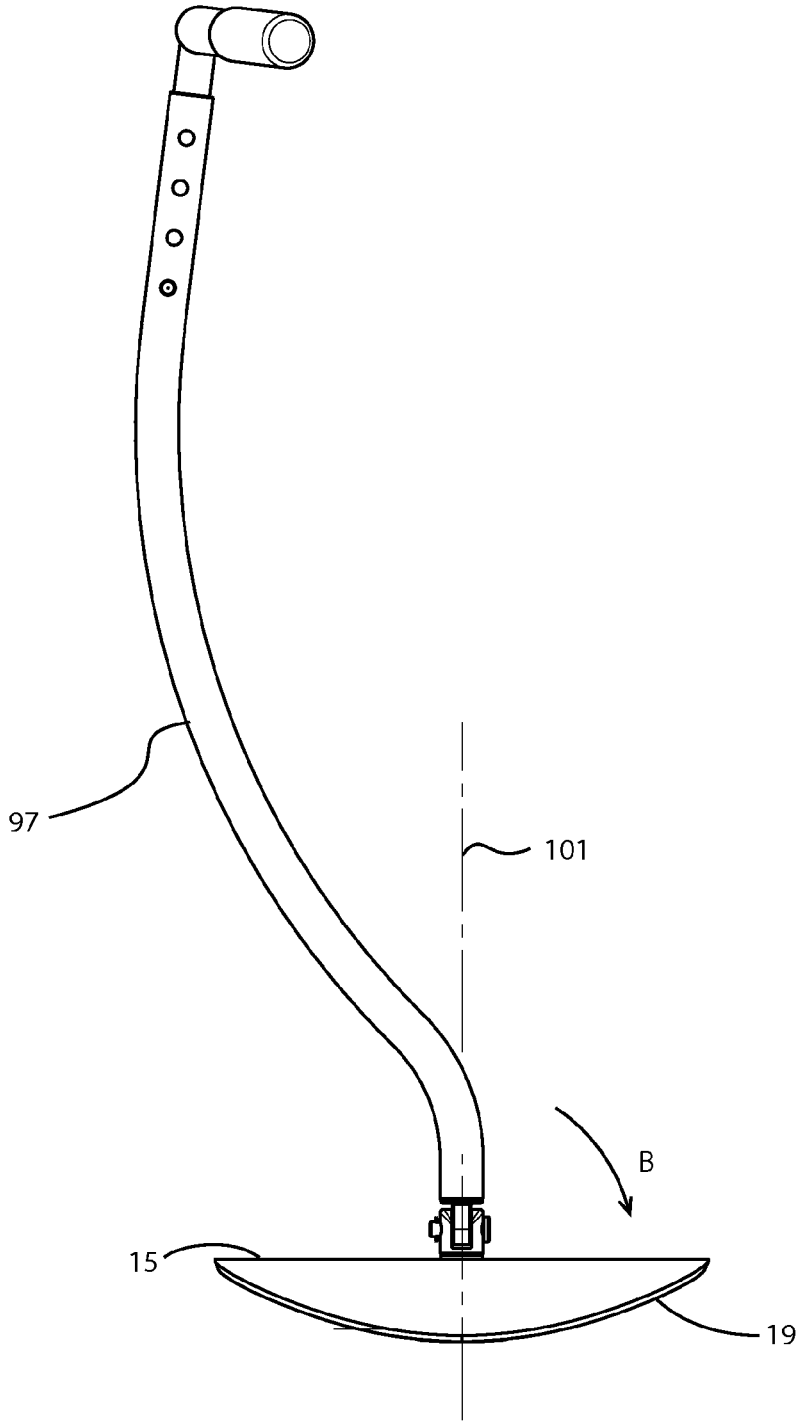
FIG. 16 is a view similar to FIGS. 12-15 showing rotation of the snowboard through 180° into a flipped position.
Figure 17:
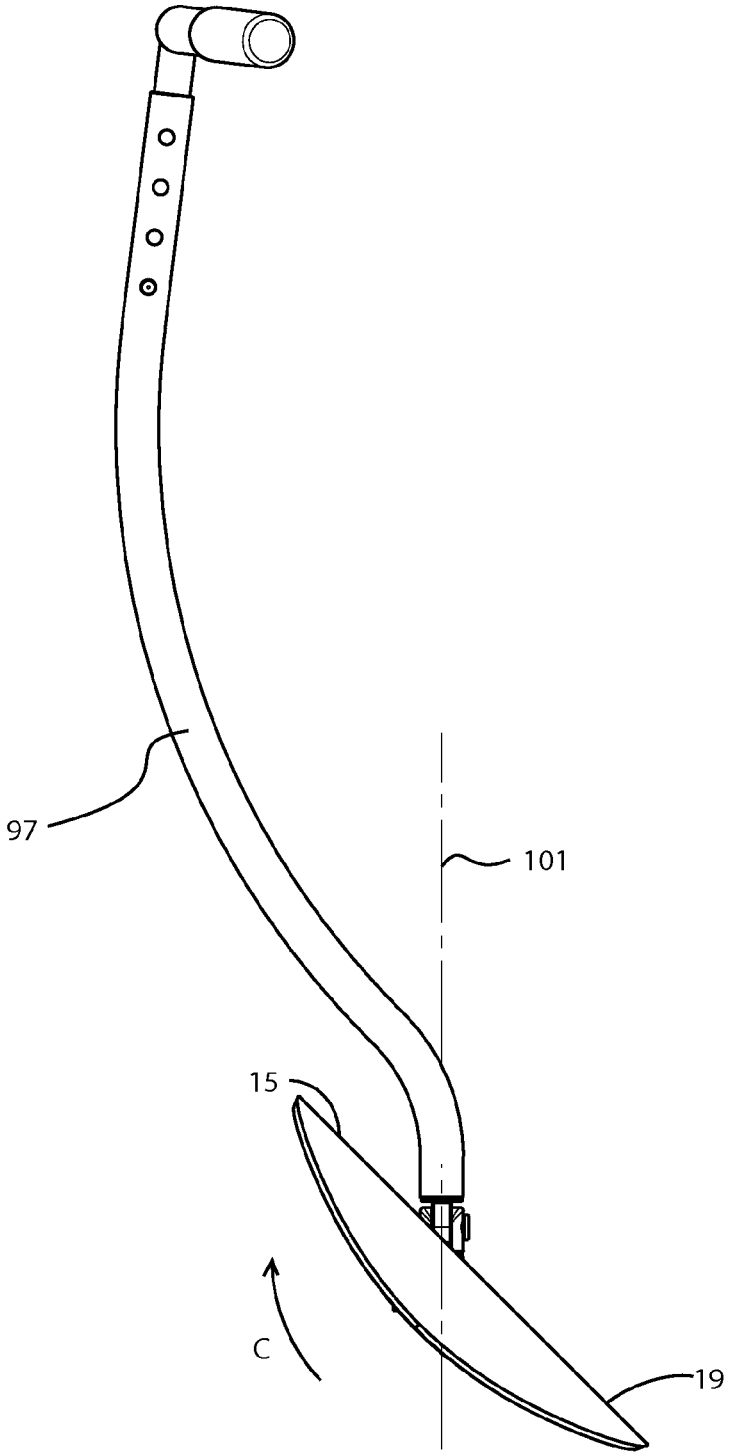
FIG. 17 is a view similar to FIGS. 12-16 showing further rotation of the snowboard past the 180° rotation of FIG. 16.
Figure 18:
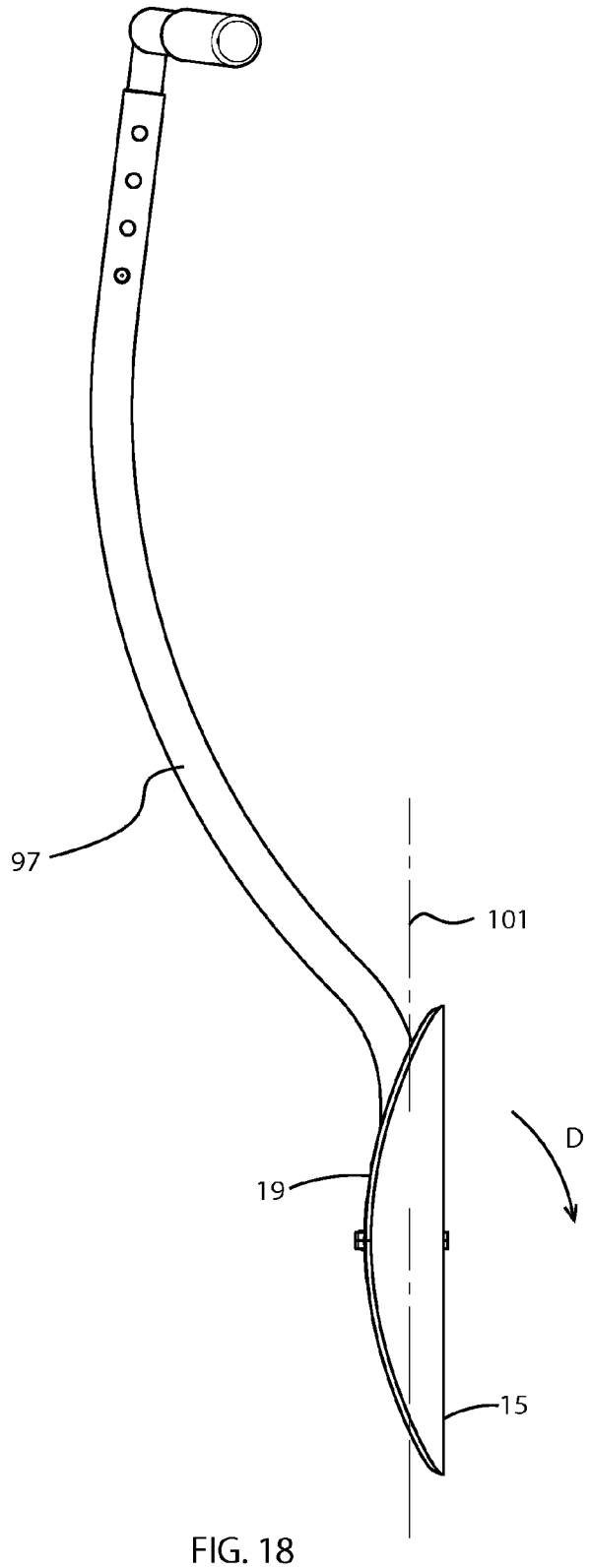
FIG. 18 is a view similar to FIGS. 12-17 showing rotation of the snowboard through 270° from the starting position of FIG. 12.
Figure 19:
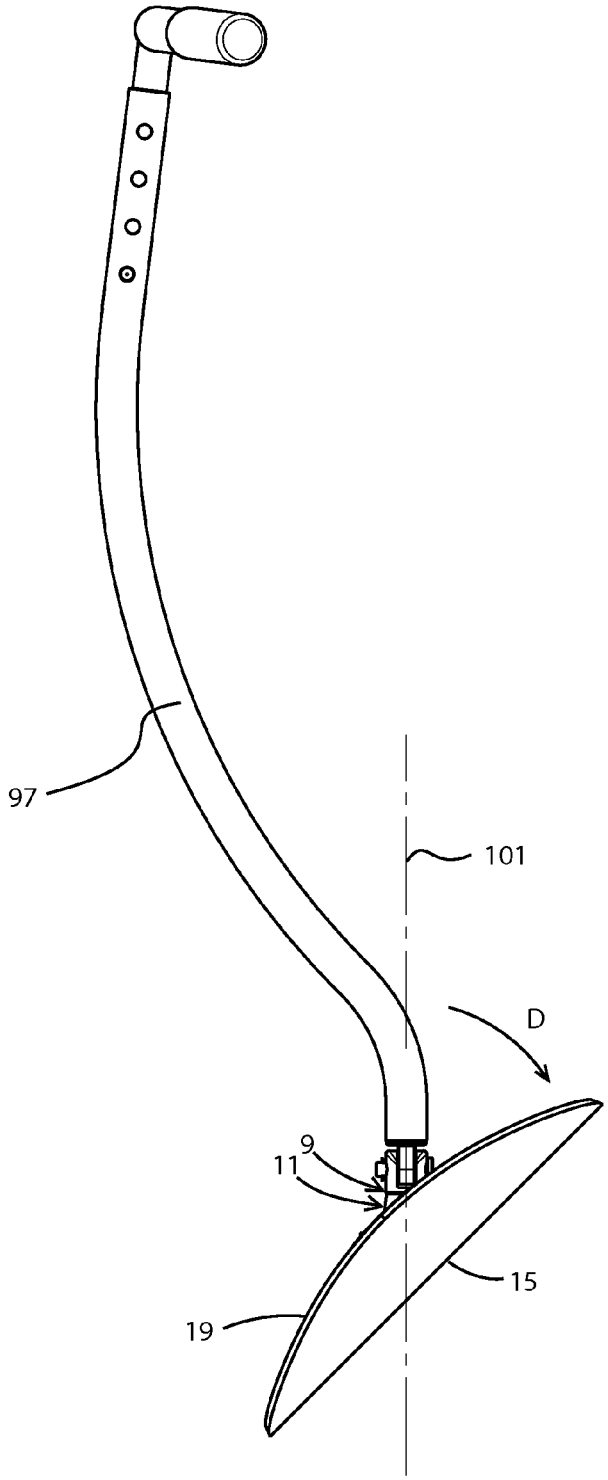
FIG. 19 is a view similar to FIGS. 12-18 showing further rotation of the snowboard beyond the 270° of FIG. 18.

FIGS. 12-19 show an example of the 360° rotation that can be achieved by runner boards 3 and 5 with respect to vertical axis 101. Runner boards 3 and 5 can remain horizontal during this rotational movement or assume other angles as discussed below. A starting position for other maneuvers is shown in FIG. 12, which will be similar to that of FIGS. 1-4. The snowboarder by pressing down on the runner boards in the direction of Arrow B (FIG. 13) causes the runner boards and strut 11 to rotate about connector 9 through any desired angle. As shown in FIG. 14, the runner boards have rotated 90° and then can continue to a 180° rotation as shown in FIG. 16 since the user's feet are not attached to the runner boards. If desired, the user can continue to rotate the runner boards in the direction of Arrow C (FIG. 17) through another 90° to a position as shown in FIG. 18 from where they can then continue to rotate as shown by Arrow D in FIG. 19 until they completely rotate through 360° as shown by Arrow D in FIG. 19, until regaining their normal upright position as shown in FIG. 12. Again, this is possible due to the rotational mounting of the runner boards by strut 11 within connector 9 which is retained in its normal position by its connection with pole 7, the handles of which are grasped by the user.

Furthermore, the pivotal mounting of pole 7 with respect to connector 9 by clevis 51 as shown in FIG. 20, provides still additional movement enabling the snowboard or handle to pivot in either direction as shown by Arrow E, with respect to vertical axis 101. Thus, this universal movement of the runner boards about both the horizontal axis and a vertical axis and the pivotal movement of the runner boards with respect to handle 7 enables a snowboarder to be able to perform nearly all of the maneuvers and tricks possible on a skateboard since the skier is not attached by any bindings to the runner boards and merely maintains some control over the runner boards through contact with pole 7. Furthermore, the runner boards can assume various angles with respect to both the horizontal and vertical as does an unattached skateboard due to the universal connection between the pole and runner boards. Thus, the snowboarder can perform not only the grab and slide tricks of a skateboard, but also the various flip tricks in which the board does a flip and/or spin. This enables the board to flip upside down and/or end over end. This enables the various tricks such as the Kickflip, Heelflip, Pop Shove-it, 360 Pop Shove-it, 360 Flip/360 Heelflip, Varial Kickflip/Varial Heelflip, and Hardflip, all to be achieved by snowboard 1.

Many simple tricks such as the Kickflip and Heelflip, as well as a Pop Shove-it can be combined with grabbing the board in different positions and/or sliding the runner boards along a platform to perform a variety of other complex tricks, heretofore only possible with a skateboard and not with a snowboard, due to the fixture of the snowboard to the feet of a snowboarder by bindings or other attachment devices.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the invention are an example and the invention is not limited to the exact details shown or described.

The invention claimed is:

1. A snowboard comprising:

a runner board having upper and bottom surfaces extending along a longitudinal axis and terminating in front and back ends;

a pole extending upwardly from the upper surface of the runner board generally along a vertical axis; and a universal joint connecting the pole to the runner board enabling the runner board to rotate substantially 360° about the vertical axis and substantially 360° about the longitudinal axis; and wherein the runner board includes a pair of board members connected by an intervening strut; and in which the universal joint includes a connector operationally mounted on the strut.

2. The snowboard defined in claim 1 wherein the strut has a generally cylindrical section which extends along the longitudinal axis of the runner board and in which the connector is rotatably mounted on the cylindrical section which enables 360° movement of the runner board around the connector.

3. The snowboard defined in claim 2 wherein the connector includes upper and lower U-shaped clamps, at least one of which is formed with an arcuate rib which seats in a complementary arcuate groove formed in the cylindrical section of the strut.

4. The snowboard defined in claim 2 wherein the universal joint includes a clevis rotatably mounted on the upper U-shaped clamp of the connector; and in which a bottom end of the pole is pivotally mounted in the clevis.

5. The snowboard defined in claim 4 wherein the clevis includes a post which is rotatably mounted within a hole formed in a circular boss projecting from the upper U-shaped clamp; and in which the clevis is rotatably attached to the upper U-shaped clamp by a fastener.

6. The snowboard defined in claim 1 wherein the pole includes a vertically extending mast and a T-shaped handle adjustably mounted on an upper end of the mast.

7. The snowboard defined in claim 6 wherein the mast has a bowed portion to provide clearance for a rider's torso; and in which the T-shaped handle has a cross bar which extends along and generally parallel with the longitudinal axis of the runner board when the mast extends vertically upwardly therefrom.

8. The snowboard defined in claim 1 wherein a plurality of friction strips are attached to the top surfaces of the runner board members and extend longitudinally therealong.

9. The snowboard defined in claim 1 wherein the pair of runner board members are substantially similar to each other, each including a stiffener attached to the board and intervening strut and extending longitudinally along at least a portion of a top surface of the runner board.

10. A snowboard comprising:

a pair of runner boards adapted to support the feet of a rider, said boards being free of any foot bindings;

a strut rigidly connecting the pair of runner boards in a spaced longitudinal orientation;

a connector rotatably connected to the strut enabling the runner boards to rotate with respect to the connector about a longitudinal axis extending through the strut and runner boards;

a pole having an upper handle extending from the connector; and a universal joint connecting the pole to the connector enabling the runner boards to rotate and pivot about the pole.

11. The snowboard as defined in claim 10 wherein the strut has a cylindrical section; and in which the connector is rotatably mounted about the cylindrical section of the strut enabling the runner boards to rotate 360° about the longitudinal axis.

12. The snowboard as defined in claim 10 wherein the connector is formed with an arcuate rib which seats within a groove formed in the cylindrical section of the strut to limit axial movement between the strut and connector while permitting rotational movement therebetween.

13. The snowboard as defined in claim 10 wherein the pole includes a mast connected at a bottom end to the universal joint and at the top end to a handle; and in which the mast has a bowed portion to provide clearance for a rider's torso.

14. The snowboard as defined in claim 13 wherein a plug is mounted in an opening at the bottom end of the mast and includes a lug which is pivotally mounted between a pair of spaced flanges of a clevis which is rotatably mounted on the connector.

15. The snowboard as defined in claim 13 wherein the handle is T-shaped and includes a cross member and a post generally perpendicularly thereto; and in which the post is adjustably mounted within an open upper end of the pole to adjust the height of the handle from the runner boards.

16. The snowboard as defined in claim 10 wherein each of the runner boards has top and bottom surfaces; in which each of the top surfaces has a generally planar section for supporting a foot of a rider; and in which each of the bottom surfaces has a generally planar surface to facilitate sliding of the runner boards on snow.

17. The snowboard as defined in claim 10 wherein each of the runner boards includes a stiffener attached to the board and an adjacent end of the strut and extends along at least a portion of a top surface of the runner board.

18. The snowboard as defined in claim 10 wherein the strut is formed with a through bore and terminates in curved end surfaces; and in which each of the runner boards is attached to a respective curved end surface of the strut by fasteners.

19. The snowboard as defined in claim 10 wherein each of the runner boards have generally top surfaces terminating in upwardly curved front and back ends; wherein the back end of one of the runner boards is attached to the strut and the front end of the other runner board is attached to the strut.

20. The snowboard as defined in claim 19 wherein a plurality of friction strips are attached to the top surface of the runner boards.

* * * * *